US005711199A

United States Patent [19]

Hesketh et al.

[11] Patent Number: 5,711,199

[45] Date of Patent: Jan. 27, 1998

[54] CLIPPING TRASH GATE FOR TRIMMING STRIP OF SHEET MATERIAL

[75] Inventors: John A. Hesketh, Nanaimo; Edsel G. Beharrell, Nanoose Bay, both of Canada

[73] Assignee: The Coe Manufacturing Company, Portland, Oreg.

[21] Appl. No.: 779,092

[22] Filed: Jan. 6, 1997

[51] Int. Cl.[6] ..... B26D 7/06; B27B 1/00

[52] U.S. Cl. ..... 83/23; 83/106; 83/347; 83/370; 144/3.1; 144/209.1; 144/357; 144/367

[58] Field of Search ..... 83/23, 105, 106, 83/107, 346, 347, 362, 367, 370, 102, 371; 144/1.1, 3.1, 209.1, 365, 329, 367, 356, 357; 364/474.08, 474.09, 474.13; 82/113

[56] References Cited

U.S. PATENT DOCUMENTS

| | | | |
|---|---|---|---|
| 3,760,667 | 9/1973 | Maxey et al. | 83/371 |
| 3,808,925 | 5/1974 | Hards | 83/346 |
| 3,861,259 | 1/1975 | Hitch | 83/106 |
| 4,672,552 | 6/1987 | Ely | 364/474.09 |
| 4,732,067 | 3/1988 | Yamada | 83/347 |
| 4,934,228 | 6/1990 | Bolton et al. | 83/106 |
| 4,989,651 | 2/1991 | Snellgrove | 144/3.1 |

OTHER PUBLICATIONS

*Raute Wood News*, "Clipping trash gate improves the bottom line", Rick Massey, Oct., 1995.

*Primary Examiner*—W. Donald Bray
*Attorney, Agent, or Firm*—Klarquist Sparkman Campbell Leigh & Whinston, LLP

[57] ABSTRACT

A trimming apparatus and method for cutting a strip of sheet material, such as wood veneer, is described including a clipping trash gate. A strip cutter including a cutter knife mounted on the trash gate for pivotal movement and a stationary cutter member cooperate to cut defective trash portions from the strip as it is conveyed past the trash gate. The trash gate opens to discharge the trash portions from the strip path through the gate. The stationary cutter member is made of soft plastic material, such as ultra high molecular weight polyethylene. The stationary cutter element is cut by the knife blade to form the cutting edge of such stationary cutter member and to simultaneously accurately align it with the knife blade cutting edge. The cutting edge of the knife blade is spaced from the stationary cutter member by a distance which is tapered along the length of the knife for progressive engagement of the knife cutting edge with the stationary cutter member to provide a scissor cutting action.

20 Claims, 3 Drawing Sheets

CLIPPING TRASH GATE FOR TRIMMING STRIP OF SHEET MATERIAL

FIELD OF THE INVENTION

The present invention relates generally to trimming apparatus and method for trimming of strip of sheet material and in particular to a clipping trash grate for trimming a strip of wood veneer produced by a veneer lathe. The clipping trash gate may be used to cut the strip of veneer as it is being conveyed to remove a portion of trash veneer and discharge the trash veneer from the conveyer path when the trash gate is open and for transmitting the remaining good veneer along the conveyer path when the trash gate is closed.

BACKGROUND OF THE INVENTION

As shown in U.S. Pat. No. 4,672,552 of Ely issued Jun. 9, 1987 it has been previously proposed to provide a method and apparatus for controlling a veneer lathe to minimize the amount of waste veneer cut by such lathe after a veneer peel break such as during roundup of the log. This has previously been accomplished by moving the knife of the lathe between a standby position remote from the log and a peel position in contact with the log under the command of a computer control system. The control system adjusts the lathe knife carriage to create a gap in the veneer flow for operation of the trash gate thereby separating the roundup trash material from the good veneer coming from the peel log. To create a gap in the veneer strip for the trash gate to open for removal of the trash veneer, the lathe knife carriage backs out of the peel and moves to a standby position after which it reenters to again begin peeling after one revolution of the log. The trash gate moves through this gap in the veneer strip between an open position where it discharges the trash veneer and a closed position to allow the remaining good veneer to be conveyed to the clipper. Also, this movement of knife carriage pulling the knife out of the log to stop the peel and then reentering the log at a precise position to begin peeling again causes the leading and trailing edges of the veneer to have a thickness taper which must be removed. This trash removal operation is complex and requires at least one complete revolution of the log which slows down veneer production thereby reducing the amount of veneer produced during a work shift.

Another method and apparatus for separating the trash roundup veneer from the good veneer is shown in U.S. Pat. No. 4,989,651 of Snellgrove issued Feb. 5, 1991 which uses a rotary sheet breaker knife to cut veneer in front of a separate trash gate. In this apparatus the veneer sheet breaker or clipper knife cuts the roundup trash veneer from the veneer strip as it is conveyed over an anvil roller which is followed by a trash gate spaced from the veneer clipper. The trash gate is raised to discharge the trash veneer and closed to transmit the good veneer along the conveyer path. The operation of the trash gate is automatically synchronized with the operation of the clipping knife so that the trash gate is open at the time when the veneer trash is cut from the remainder of the veneer strip and then is closed. In this prior veneer clipping apparatus the clipping knife rotates about its own axis above the anvil roller and cuts the veneer strip by engagement with such anvil roller. The speed of such knife is controlled to vary during one revolution depending upon the angular position of the knife by means of a hydraulic control system, which is extremely complex and expensive compared to the clipping trash gate apparatus of the present invention.

It has also been proposed by Durand-Raute Industries, as described in the article "Clipping Trash Gate Improves the Bottom Line" in the publication *Raute Wood News*, October 1995 at pages 12 and 13 to provide a veneer clipping knife on the trash gate for clipping the veneer without stopping peeling. However a fixed anvil cutter member of metal is employed so that when the clipper knife is sharpened after dulling as a result of wear it is difficult and time consuming to adjust and align the knife and anvil member to provide the proper knife gap of about three thousandths of an inch or less. This causes much lost production time.

SUMMARY OF THE INVENTION

It is therefore one object of the present invention to provide an improved trimming apparatus and method for trimming a strip of sheet material to remove defective strip portions in a fast and accurate manner.

Another object of the invention is provide such a trimming apparatus and method in which a clipping trash gate is employed for trimming the strip of sheet material to remove a defective trash portion of the strip by cutting it with a knife on such trash gate and for discharging the trash portion from the path of the remaining good portion of such strip without stopping the flow of the strip material for a more efficient operation.

A further object of the invention is provide such a method and apparatus in which the strip trimming apparatus has a cutter which includes a movable cutter knife separate from a stationary cutter member made of a plastic material which is softer than the material of the knife so that the knife may cut the stationary cutter member to form a cutting edge on such member and to renew such cutting edge after sharpening the knife thereby accurately aligning the cutter knife with the stationary cutter member in a simple, fast, accurate and inexpensive manner.

An additional object of the invention is to provide an improved veneer strip trimming apparatus and method employing a clipping trash gate for cutting the veneer to remove trash veneer and for discharging such trash veneer from the conveyer path of the veneer through the trash gate without stopping the flow of the veneer to remove the trash veneer in a fast and economical manner.

Still another object of the invention is to provide such a veneer strip trimming apparatus in which the clipping trash gate is moved automatically by actuating cylinders operated by a computer control system to clip the veneer and to discharge the trash veneer from the path of the good veneer in a fast and economical manner.

A still further object of the present invention is to provide such a trimming apparatus and method for trimming a strip of wood veneer including a clipping trash gate having a movable cutter knife mounted thereon and a stationary cutter member of synthetic plastic material such an ultra high molecular weight polyethylene, softer than the material of the knife which is cut by the knife to produce a cutting edge on the stationary member which is accurately aligned and properly spaced from the cutter for improved operation of the trimmer apparatus and method.

A still additional object of the invention is to provide such a veneer trimmer apparatus and method in which the movable knife on the trash gate is provided with a cutting edge which is spaced from the cutting edge of the stationary cutter member by a distance which tapers along the length of the knife to provide a scissor cutting action thereby improving the performance of the knife.

The foregoing and other objects, features, and advantages of the invention will become more apparent from the following detailed description of a preferred embodiment which proceeds with reference to the accompanying drawings.

DETAILED DESCRIPTION OF A PREFERRED EMBODIMENT

Figure 1:
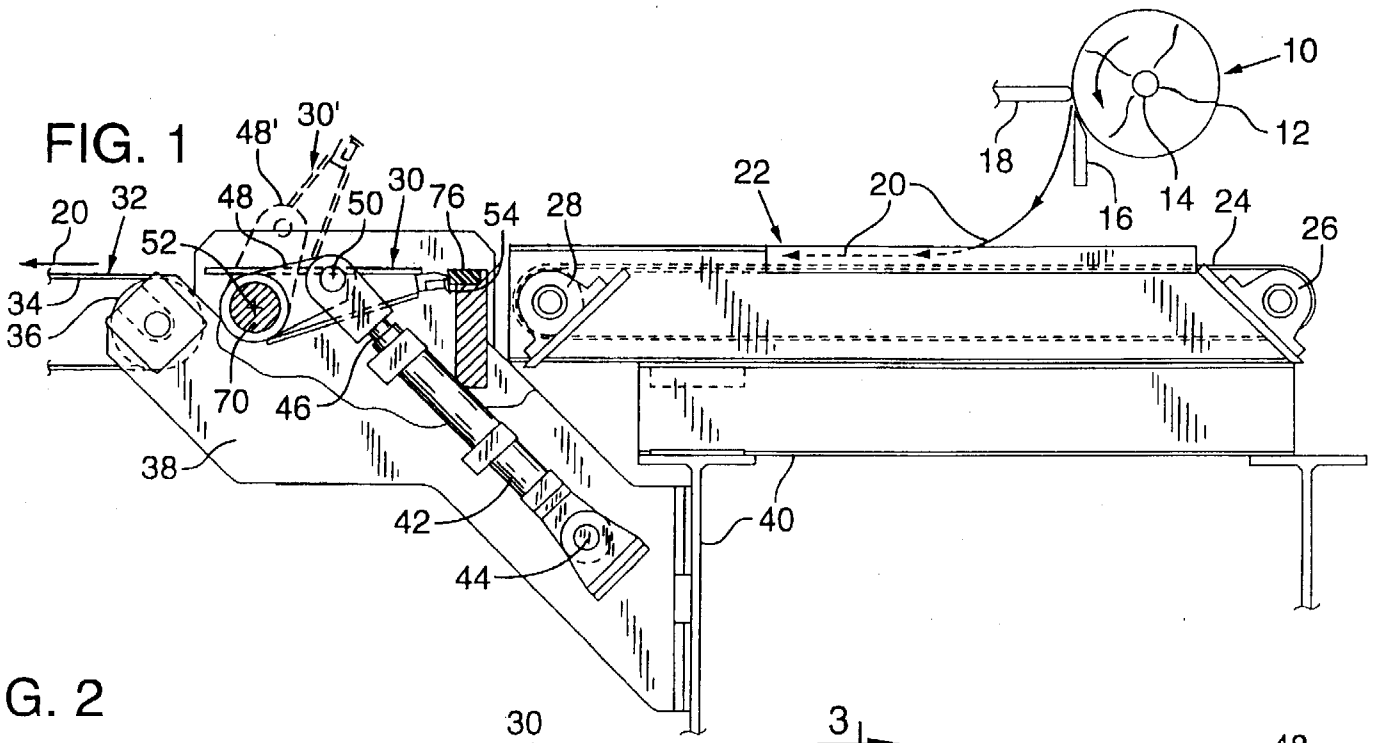
FIG. 1 is a side elevation view of a strip trimmer apparatus having a clipping trash gate in accordance with the present invention.

As shown in FIG. 1 the strip trimmer apparatus of the present invention may be provided in a wood veneer strip production installation including a veneer lathe 10 for peeling a log 12 which is rotated about the axis of a pair of lathe spindles 14 at the opposite ends of such log. The lathe includes a lathe knife 16 and a nose bar 18 both which engage the log and move toward the log center as it rotates to peel a strip of wood veneer 20 from such log. The lathe knife 16 and nose bar 18 are mounted on a carriage (not shown) which is moved toward the axis of rotation of the spindles 14 under computer control during peeling.

The veneer strip 20 is fed onto a input conveyer 22 which includes a moving conveyer element 24 which may be in the form of an endless belt that encircles two support pulleys 26 and 28 at the opposite ends thereof one of which may be connected to motor for driving such belt. As a result the veneer strip 20 is conveyed along a conveyer path across the top of the conveyer 22 through a clipping trash gate 30 which is shown in its closed position by solid lines in FIG. 1. The veneer strip 20 is conveyed across the trash gate 30 in the closed position shown, to an output conveyer 32 which has a moving conveyer element 34 in the form of an endless conveyer belt which passes around two pulleys 36 at the opposite ends thereof one of which is connected to a motor for driving the belt. The upper surface of the output conveyer belt may be spaced approximately ½" below the top of the clipping trash gate 30 and the top of such trash gate may also be positioned approximately ¾" below the top of the input conveyer belt 24.

The clipping trash gate is pivotally mounted between two fixed support member 38 which are attached to the lathe support frame 40 on which the conveyers 22 and 32 are mounted. A pair of fluid operated actuating cylinders 42 are pivotally mounted on the two support members 38 by pivotal connections 44 at the lower end thereof and are attached at the outer end of their pistons 46 to a pair of lever arms 48 at upper pivot connections 50. The lever arms 48 are attached to a shaft 70 for rotating the trash gate 30 about a pivot axis 52 between the closed solid line position 30 and the open phantom line position 30' shown in FIG. 1.

Figure 2:
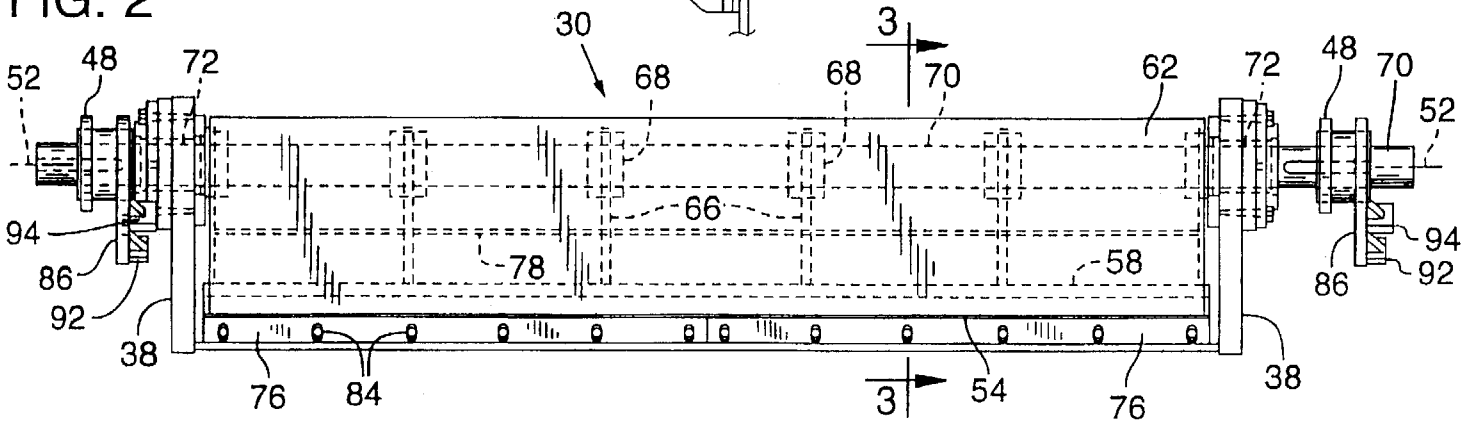
FIG. 2 is a plan elevation view of the trash gate in the apparatus of FIG. 1.
Figure 3:
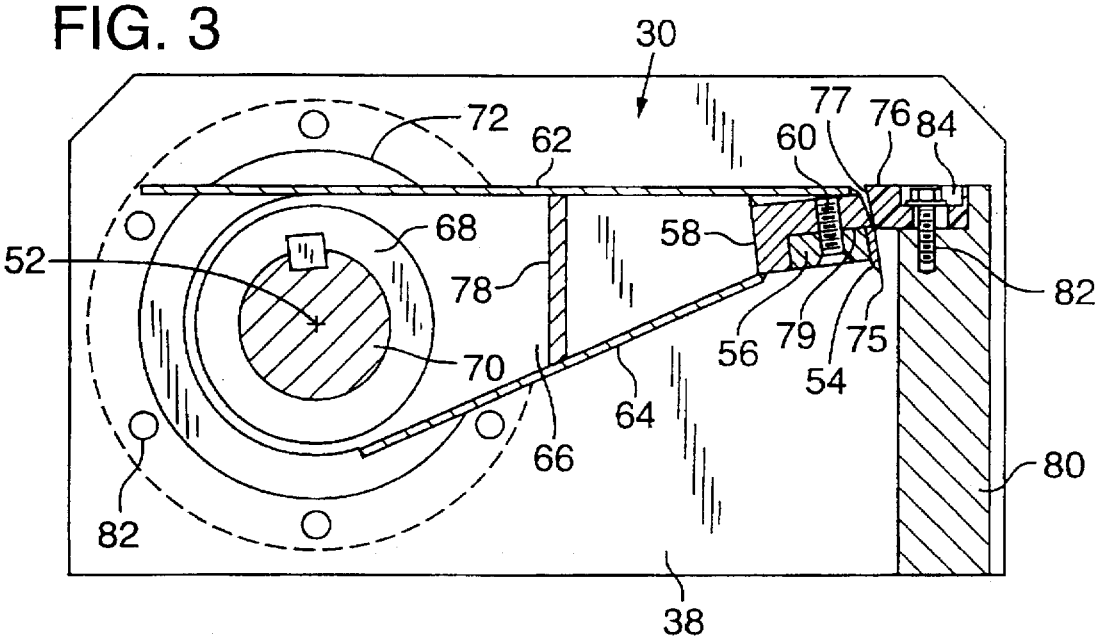
FIG. 3 is an enlarged vertical section view of the trash gate taken along the line 3—3 in FIG. 2.
Figure 5:
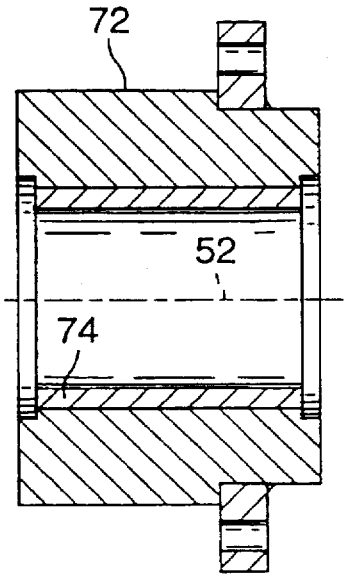
FIG. 5 is an enlarged vertical section view of a bearing supporting the trash gate shaft.
Figure 6:
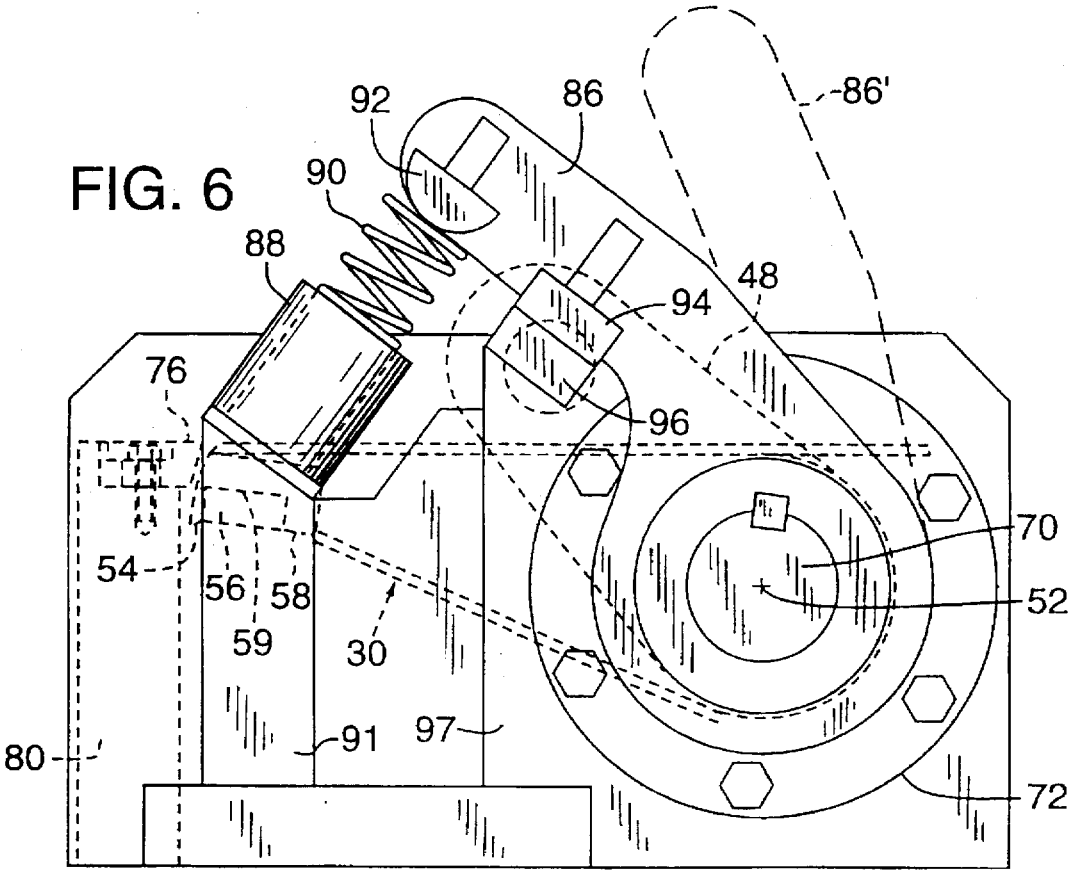
FIG. 6 is an enlarged end view of the trash gate of FIG. 2.

As shown in FIGS. 2 and 3 the clipping trash gate 30 includes a movable knife member 54 which is attached by bolts to a knife holder 56 and such knife holder is secured to a mounting member 58 on such trash gate by mounting bolts 60. The clipping knife 54 may have a total length of approximately 9 feet and be made in two sections of 4½ foot length. Also the knife holder 56 may be made of two sections of similar length to the knife. The knife mounting member 58 is secured to an upper plate 62 and a lower plate 64 of the trash gate in any suitable manner such as by welding. As shown in FIG. 2 the upper plate 62 and the lower plate 64 are secured to vertical support plates 66 spaced along the length of the trash gate 30 so that such upper and lower plates diverge from each other to provide the trash gate with a triangular cross section. The trash gate is provided with circular connector members 68 which are keyed to a common pivot shaft 70. The shaft 70 is rotatively mounted within bushings 72 at the opposite ends of the trash gate. As shown in FIG. 5 each of the bushings 72 contains a sleeve bearing 74 of aluminum bronze metal or other similar long wearing bearing material which maintains the precise knife gap spacing between the movably cutter knife 54 and a stationary cutter member or anvil 76. A reinforcing spacer plate 78 is positioned between the upper plate 62 and lower plate 64 of the trash gate for separating such plates and enabling the lower plate to diverge inwardly toward the upper plate from the rear end adjacent shaft 70 to the front end adjacent the cutting knife mounting member 58.

Figure 4:
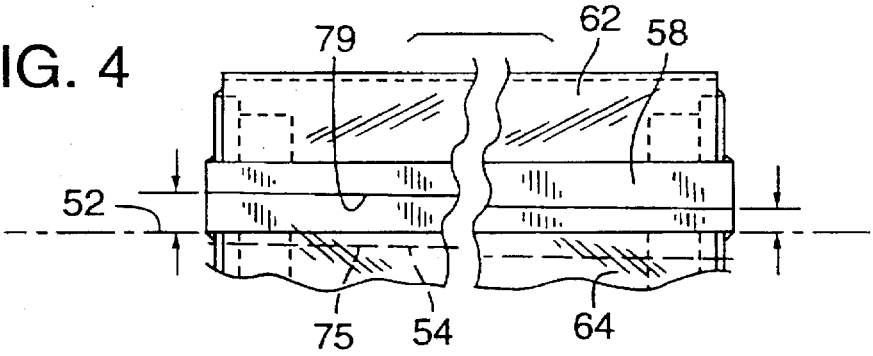
FIG. 4 is a side elevation view of the trash gate of FIG. 2 in a horizontal position with the knife removed.

The stationary cutter member or anvil 76 is made of a plastic material such as ultra high molecular weight (UHMW) polyethylene, nylon, or polyurethane. The anvil member 76 extends along the entire length of the knife 54 and is positioned adjacent such knife in its closed position as shown in FIG. 3. In this position the front portion of the knife holder 58 has its bottom surface 79 tapered and spaced above the axis of rotation 52 by a distance which tapers from 1.0 inch on the left end to ⅝ inch on the right end of the knife, as shown in FIG. 4. As a result the knife 54 is mounted on the knife holder so that its knife edge 75 is parallel to the bottom surface of such knife holder and is tapered relative to the top surface of the anvil so that the knife blade and the anvil 76 perform a scissor like cutting action by progressive engagement of the knife cutting edge 75 with the stationary cutter member or anvil to smoothly cut the veneer strip 20. As hereafter discussed also the plastic anvil 76 when being cut to form a cutting edge 77 on such anvil the plastic material compresses slightly. It then springs back and forms a somewhat tight fit. The anvil member 76 is mounted on a fixed support 80 by a plurality of bolts 82 spaced along its length. The anvil 76 is provided with a plurality of bolt holes in the form of elongated slots 84 which permit lateral adjustment of the anvil member toward the knife blade 54. The cutting edge 77 on the front of the anvil member 76 is formed by the knife 74 cutting the anvil member as the clipping trash gate 30 pivots from a raised open position 30' to a lowered close position 30 initially before the veneer strip 20 is cut. As a result the cutting edge 77 on the front surface of the anvil 76 exactly matches the shape of the knife blade 54 and the knife blade and the anvil is provided with the proper spacing for efficient cutting. In this regard it should be noted that when UHMW polyethylene or other plastic is used for the anvil 76 the formation of cutting edge 77 provides an interference fit with the knife blade. In addition, after the edge on the anvil 76 wears, a new cutting edge 77 is provided on the front of the anvil 76 by advancing the anvil member toward the knife blade after loosening the bolts 82 to allow the anvil to be moved forward by inserting shims between the back of the anvil and the supports. When the bolts 82 are properly positioned within the slots 84 such bolts are tightened and then the knife blade is again cause to cut the anvil to provide a new cutting edge 77 on the front of the anvil. As a result there is provided a simple, inexpensive, fast and accurate way of sharpening the cutting edge 77 of the anvil and realigning the knife blade and the anvil to provide proper alignment spacing to cut the veneer strip. It should be noted that the anvil support 80 and the bolts 82 are preferably formed of steel and such bolts are fastened in threaded holes in the top of the anvil support. Similarly the knife blade 54, the knife holder 56, the bolts 60 and the mounting member 58 are all made of steel for adequate strength.

In order to cushion the impact of the clipping trash gate 30 as it swings from an open to a closed position a resilient shock absorber device 88, 90 may be provided at each end of the gate to engage an actuator 92 on a separate arm 86 which is keyed to the shaft 70 of the trash gate for rotation therewith. A hydraulic shock absorber cylinder 88 and associated coil spring 90 are mounted on a support 91 fixed to the frame at a position outside the end of the cutting knife 54 for engagement by the actuator 92 fixed to the arm 86. In addition, a secondary stop 94 may be mounted on the arm 86 for engagement with a fixed stop 96 which is attached to a second support 97 fixed to the frame. Thus as the resilient shock absorber 88, 90 bottoms out and reaches the limit of its travel the secondary stop 94 engages the fixed stop 96.

Figure 7:
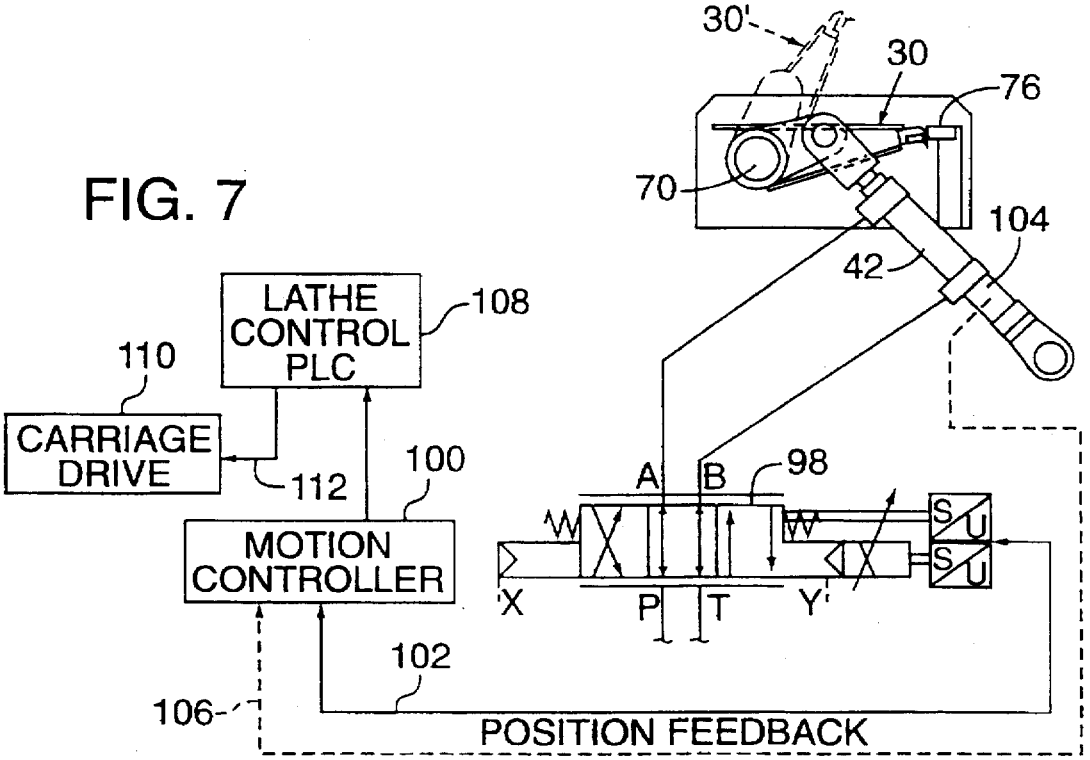
FIG. 7 is a block diagram of a control system for the apparatus of FIG. 1.

A computer control system is shown in FIG. 7 for controlling the actuating cylinder 42 by operation of a control valve 98. The control valve 92 is operated by a motion controller 100 having an output 102 connected to a solenoid type actuator in such control valve. A position transducer 104 within the cylinder 42 produces a position signal indicating the position of the piston in such cylinder which corresponds to the position of the clipper trash gate 30 as it moves between its closed position 30 and its open position 30'. The position transducer 104 has its electrical output connected through line 106 to an input of the motion controller 100. The motion controller 100 is controlled by a programmable logic controller (PLC) 108 which also functions as the lathe control computer. Thus the lathe control programmable logic controller 108 is also connected to the lathe carriage drive 110 through connector lines 112 for movement of the lathe knife 16 and nose bar 18. It should be noted that there is one valve 98 for controlling two actuating cylinders 42 at the opposite ends of the clipping trash gate 30 for rotating such trash gate about its shaft 70 even though only one cylinder and valve is shown in FIG. 7.

In view of the many possible embodiments to which the principles of our invention may be applied, it should be recognized that the illustrated embodiment is only a preferred example of the invention and should not be taken as a limitation on the scope of the invention. Rather, the scope of the invention is defined by the following claims.

We claim:

1. Veneer trimmer apparatus comprising:

a conveyor for conveying a strip of wood veneer along a predetermined path;

a clipper for cutting said veneer as it is conveyed along said path to separate a trash portion of said veneer strip from the remaining veneer strip;

a movable gate for removing the trash veneer from the path of the remaining veneer strip;

said clipper including a movable cutter device mounted on said gate for movement with said gate between a cutting position and a discharge position, and a stationary cutter member mounted on said path of said veneer separate from said gate;

said movable cutter device including a knife; and said stationary cutter member being made of a plastic material which is softer than the material of the knife and being mounted adjacent said movable cutter device in said cutting position so that the knife edge cuts said stationary cutter member to form a cutting edge on the stationary cutter member which cooperates with said knife to cut said veneer.

2. A trimmer apparatus in accordance with claim 1 in which the gate is mounted to pivot about a pivot axis to move the movable cutter device about an accurate path between said cutting position and said discharge position.

3. A trimmer apparatus in accordance with claim 2 in which the gate is pivoted by a fluid operated cylinder mechanism.

4. A trimmer apparatus in accordance with claim 1 in which the movable cutter device includes a knife holder which releasably attaches the knife blade to the movable cutter device and holds the knife so that its cutting edge is spaced from the stationary cutter member by a distance which is tapered along the length of the knife for progressive engagement of the knife cutting edge with the stationary cutter member to provide a scissor cutting action.

5. A trimmer apparatus in accordance with claim 1 in which the stationary cutter member is made of ultra high molecular weight polyethylene.

6. A trimmer apparatus in accordance with claim 1 in which the stationary cutter member is made of a plastic taken from group of polyethylene, nylon and polyurethane.

7. A trimmer apparatus in accordance with claim 1 in which the movable gate includes a top plate that extends across the gate opening in the cutting position of such gate to allow the remaining veneer to travel past said gate along said path.

8. A trimmer apparatus in accordance with claim 7 in which the gate also includes a bottom plate which extends downward and diverges from said top plate in said cutting position and which deflects the trash veneer downward in the discharge position where said gate is raised to extend upward across said path.

9. A trimmer apparatus in accordance with claim 8 in which the gate is of triangular cross section and the cutter device is secured to the gate at a position where the plane of the top plate intersects the plane of the bottom plate, and the gate is pivoted about a shaft extending between two bushings attached to the ends of the top plate and the bottom plate which are opposite from the ends attached to the cutter device, said bushings having sleeve bearings for accurate positioning of the knife relative to the stationary cutter member.

10. Strip cutter apparatus for cutting a strip of sheet material, comprising;

a movable cutter device including a knife;

a stationary cutter member made of a plastic material softer than the material of said knife;

an operating device for moving the movable cutter device between a cutting position and a rest position;

a support device for supporting said stationary cutter member in a position so that the stationary cutter member is cut by the knife in said cutting position to form a cutting edge on said stationary cutter member;

a feeder device for feeding a strip of sheet material through the strip cutter; and a control device for actuating the operating device to move the knife from the rest position to the cutting position to cut the strip between said knife and said cutting edge of said stationary cutter member.

11. A cutter apparatus in accordance with claim 10 which also includes a mounting device for mounting the knife so that its cutting edge is spaced from the stationary cutter member by a variable distance which is tapered along the length of the knife for progressive engagement of the knife cutting edge with the stationary cutter member to provide a scissor cutting action.

12. A cutter apparatus in accordance with claim 10 in which the support device is adjustable for adjusting the position of the stationary cutter member relative to the knife to move the stationary cutter member to a new cutting position where the knife cuts the stationary cutter member to form a new cutting edge on said cutter member when the old cutting edge becomes worn out.

13. A cutter apparatus in accordance with claim 10 in which the stationary cutter member is made of ultra high molecular weight polyethylene.

14. A cutter apparatus in accordance with claim 10 in which the sheet material is wood veneer and which also includes a trash gate for removing trash portions after cut from the veneer, by opening the trash gate to cause the trash portion to be discharged from the path of the remaining veneer.

15. A cutter apparatus in accordance with claim 14 in which the movable cutter device is mounted on the trash gate and the trash gate is supported form pivotal movement between a closed cutting position and a open discharge.

16. A method of operating a strip cutter comprising the steps of:

providing a strip cutter having a movable cutter device and a stationary cutter member, said movable cutter device including a knife having a knife blade and said stationary cutter member being made of a plastic material which is softer than the material of said knife;

positioning said stationary cutter member in a cutting position adjacent said movable cutter device;

moving the knife toward the stationary cutter so that said knife blade cuts said stationary cutter member to form its cutting edge and simultaneously align the knife blade with the cutting edge of the stationary cutter member;

feeding a strip of sheet material through the veneer clipper; and moving said movable cutter device and said knife from a rest position to a cutting position to cut said veneer between said knife and said cutting edge of said stationary cutter member.

17. A method in accordance with claim 16 including mounting the knife so that its cutting edge is spaced from the stationary cutter member by a variable distance which is tapered along the length of the knife for progressive engagement of the knife cutting edge with the stationary cutter member to cause a scissor cutting action.

18. A method in accordance with claim 16 which includes the steps of sharpening the knife cutting edge, moving the stationary cutter member toward the knife into a new cutting position, and pivoting the knife toward the stationary cutter member so that the knife cuts said stationary cutter member to form a new cutting edge when the old cutting edge becomes worn out.

19. A method in accordance with claim 16 in which the stationary cutter member is made of a plastic taken from the group of polyethylene, nylon and polyurethane.

20. A method in accordance with claim 16 in which the sheet material is wood veneer, the strip of veneer is cut by the knife to remove a trash portion of veneer, and a trash gate is opened to remove said trash portion from the path of the remaining veneer as it is conveyed past the cutter.

* * * * *